US005467562A

United States Patent [19]

Holland

[11] Patent Number: 5,467,562

[45] Date of Patent: Nov. 21, 1995

[54] PREFABRICATED MODULAR CLOSET UNIT

[76] Inventor: Phillip R. Holland, 453 Westcrest Dr., Nashville, Tenn. 37211

[21] Appl. No.: 63,410

[22] Filed: May 18, 1993

Related U.S. Application Data

[63] Continuation-in-part of Ser. No. 532,584, Jun. 4, 1990, Pat. No. 5,319,903.

[51] Int. Cl.[6] ..... A47G 29/00

[52] U.S. Cl. ..... 52/79.1; 52/79.9

[58] Field of Search ..... 52/79.1, 79.6, 52/79.9, 79.12, 36.1, 36.2, 36.4, 36.5, 745.02, 745.13, 745.16; 249/19, 22; 312/242, 200

[56] References Cited

U.S. PATENT DOCUMENTS

| | | | |
|---|---|---|---|
| 2,712,863 | 7/1955 | Busch | 52/79.1 |
| 3,110,907 | 11/1963 | King | 52/79.1 X |
| 3,162,863 | 12/1964 | Wokas . | |
| 3,845,600 | 11/1974 | Moore | 52/222 |
| 4,031,572 | 6/1977 | Harding | 52/79.1 |
| 4,077,686 | 3/1978 | Bukaitz . | |
| 4,095,860 | 6/1978 | Henson | 312/242 |
| 4,236,772 | 12/1980 | Henson | 312/242 |
| 4,238,858 | 12/1980 | Maihart . | |
| 4,432,171 | 2/1984 | Boot | 52/79.1 |
| 4,553,276 | 11/1985 | Paradis . | |
| 4,788,802 | 12/1988 | Wokas . | |
| 4,998,388 | 3/1991 | Englehart . | |

*Primary Examiner*—Carl Friedman
*Assistant Examiner*—Robert J. Canfield
*Attorney, Agent, or Firm*—Woodard, Emhardt, Naughton, Moriarty & McNett

[57] ABSTRACT

A prefabricated modular closet is disclosed comprising a base, an integral enclosure having sidewalls, a back wall, a front wall with an opening therein, and a ceiling, and furring attached to the exterior surface of the enclosure. An integral floor may be provided and the flooring may comprise a frame having a truss structure for enhanced rigidity. A method for assembling a wall, including an integral prefabricated closet, is disclosed in which the closet is located and secured to a floor, and then wall framing members are thereafter erected using the prefabricated closet as part of the load bearing structure and with wall panel hung directly thereon.

7 Claims, 8 Drawing Sheets

PREFABRICATED MODULAR CLOSET UNIT

This application is a continuation-in-part of U.S. patent application Ser. No. 07/532,584, filed on Jun. 4, 1990, now U.S. Pat. No. 5,319,903 by the same inventive entity and entitled PREFABRICATED MODULAR STORAGE UNIT.

BACKGROUND OF THE INVENTION

This invention pertains to a prefabricated modular closet, and more particularly, to a closet construction which is prefabricated at one location and installed at a building site.

In constructing new buildings, building additions to existing structures, and remodeling interior rooms of existing structures, the process of building closets requires the labor of a number of trades. These trades include a framer, an electrician, a dry waller, a dry wall finisher, a trim man, a painter, and a carpet installer. In a conventional closet construction, wood studs frame the closet. Electrical wire is installed inside the wood framing. Dry wall is then affixed to the framing to form the interior and exterior surface of the closet. The dry wall is then finished and painted. Finally, the carpet is installed in the closet. The process of coordinating and scheduling skilled persons to perform these functions is both time consuming and expensive as all the persons are typically skilled craftsmen.

In the past various means have been developed to facilitate more efficient and less expensive means of providing closets. U.S. Pat. No. 4,223,967 issued Sep. 23, 1980 to Royer discloses one such modular closet unit. The '967 patent consists of prefabricated floor, ceiling and wall units which are assembled together in situ and form the walls of the enclosure with external frames forming a backing adapted to receive standard wall panels. The floor, ceiling and wall units are secured together by means of a special clip. U.S. Pat. No. 4,371,221 issued Feb. 1, 1983 to Citterio discloses a composite modular element structure for furnishings. The '221 patent does not disclose a prefabricated modular closet of the present invention. U.S. Pat. No. 3,585,767 issued Jun. 22, 1971 to Lindingo et al. discloses a prefabricated room unit.

BRIEF DESCRIPTION OF THE DRAWINGS

The invention will now be disclosed, by way of example, with reference to specific embodiments thereof illustrated in the accompanying drawings, in which.

SUMMARY OF THE INVENTION

This invention sets out to present an efficient and economical means for providing a closet construction.

With this general aim, it is a basic object of this invention to provide a modular, prefabricated closet.

Another object of this invention is to provide a closet construction which is fabricated at one location and installed at a building site.

Another object of this invention is to provide a modular closet which reduces the costs of construction.

Yet another object of this invention is to provide a prefabricated closet which has a stronger, damage resistant interior.

Another object of the present invention is to provide a prefabricated closet having shelving supports.

Still another object of this invention is to provide a modular closet having a simple, non-mechanical ventilation system.

Another object of the present invention is to provide a prefabricated closet having a lighting assembly pre-wired therein so that only one electrical field connection is required.

In one form thereof the present invention discloses a prefabricated closet assembly for installation in conjunction with a structure. The closet assembly has a base plate which provides a closet floor and an integral enclosure having top, front, rear, and side walls so that the enclosure and base plate define a closet volume. The enclosure has an interior surface and an exterior surface and contains an opening to provide access to the closet volume. The closet assembly also has a connection means, integral with and protruding from the exterior surface of the enclosure to facilitate the attachment of the modular closet to the structure and the attachment of a wall surface to the enclosure.

In another form thereof, the present invention discloses a prefabricated closet for installation in conjunction with a structure. The closet has an enclosure defining a closet volume. The enclosure has an interior surface and an exterior surface and contains an opening to provide access to the closet volume. The closet also has a frame means, on the exterior surface of the enclosure, to facilitate attaching the modular closet to the structure and attaching a wall surface to the enclosure.

Another object of the present invention is to provide a simple and efficient method of installing a prefabricated closet unit.

In the present invention there is provided a method for installing a prefabricated modular closet in a structure comprising the following steps. A base plate is affixed at a selected position on the floor of the structure. An integral enclosure having a ceiling, a rear wall, opposite side walls, and a front wall containing an opening therein is provided. The integral enclosure is positioned relative to the base plate so that the integral enclosure and base plate define a closet volume. The integral enclosure and base plate are then affixed to the structure.

DESCRIPTION OF THE PREFERRED EMBODIMENT

Figure 1:
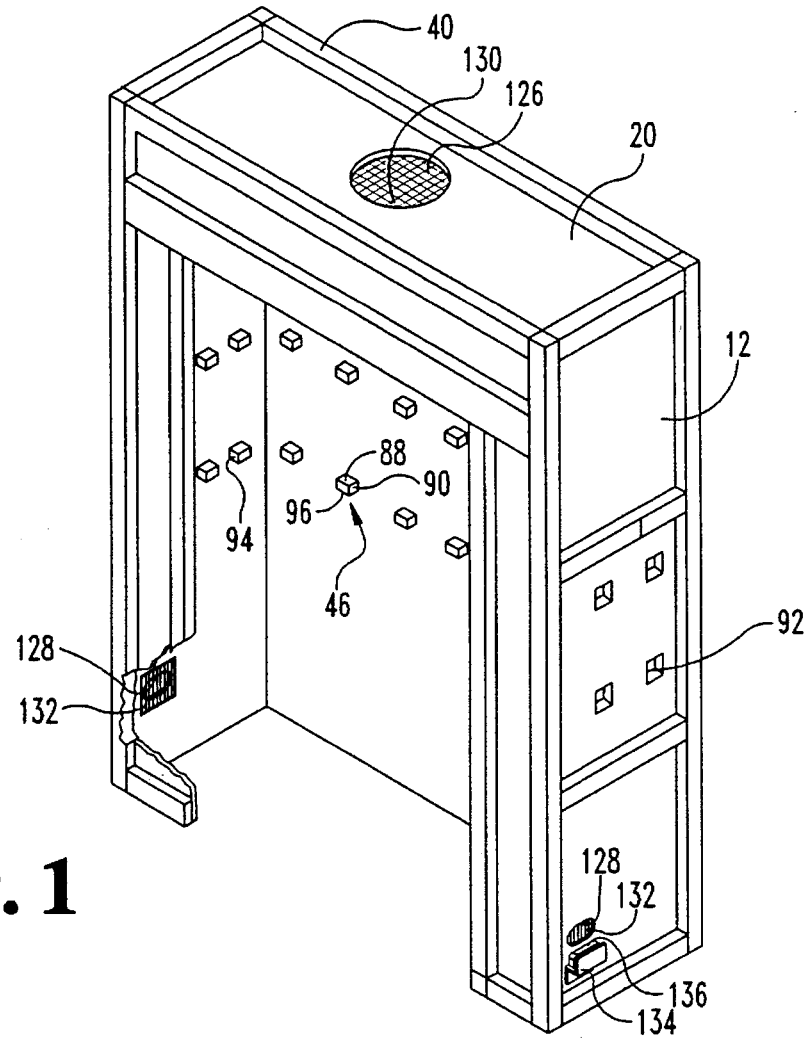
FIG. 1 illustrates a perspective view partially broken away in a section of a first specific embodiment of the modular closet in accordance with the invention.
Figure 2:
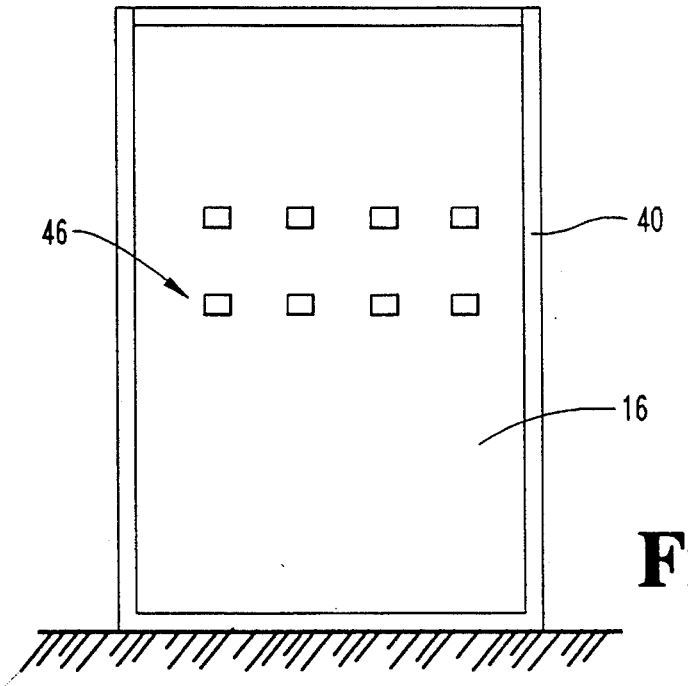
FIG. 2 illustrates a rear view of the modular closet of FIG. 1.

Referring now in detail to the drawings, there is shown a prefabricated closet, generally indicated as 10, (FIG. 1). The closet 10 has a first sidewall 12, a second sidewall 14, a back wall 16, a front wall 18, and a ceiling 20. The front wall 18 contains an entrance opening 22 therein so as to provide access into and out of the closet. The first sidewall 12, second sidewall 14, back wall 16, front wall 18 and ceiling 20 are formed as a single integral unit. The single integral unit may be made of molded acrylic or some other similar type of material suitable for molding and having a durable, smooth finish. This molded acrylic unit is reinforced by a laminate fiberglass reinforcement. Alternatively, the closet 10 can be structured so that walls 12, 14, 16, 18, and ceiling 20 each consist of an independent panel. These panels can be assembled at the building site to form the integral unit.

The closet 10 has framing 40 attached to the exterior surface thereof. Framing 40 serves as a location for the attachment of drywall or other wall finishing material to the exterior surface of the closet 10. Preferably, the framing 40 is made of 2"×2" wood furring strips and is affixed to the peripheral edges of a sidewall 12, sidewall 14, back wall 16, front wall 18 and ceiling 20 of closet 10 as shown in the drawings.

Figure 3:
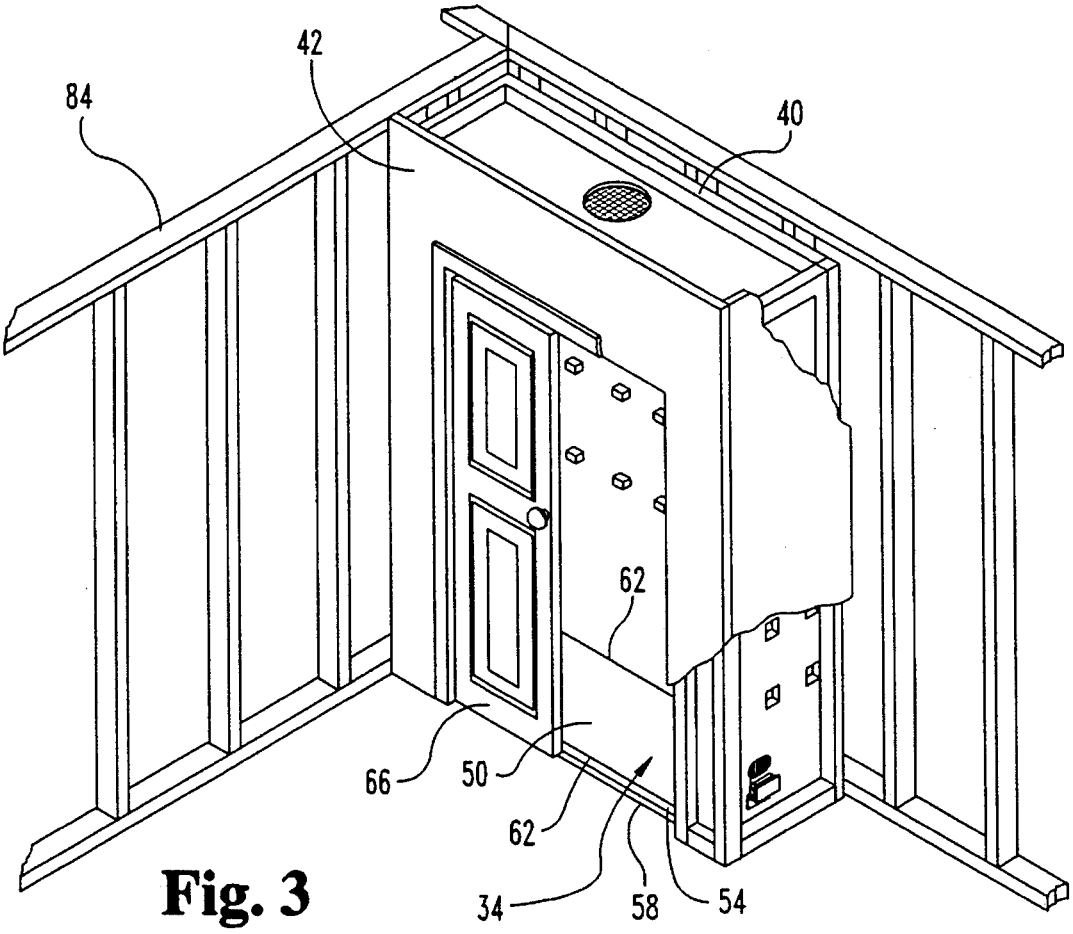
FIG. 3 illustrates a perspective view of the modular closet of FIG. 1 installed in a structure and having partially applied drywall and door assembly.

As can be seen in FIG. 3, a base, generally indicated as 34, is secured to floor 80 of a structure at the location where the builder desires to install the closet 10. The preferred method of attaching base 34 to floor 80 is by screwing base 34 to floor 80 at lip 58 of base 34 so that the heads of the screws are covered by the bottomedge of closet 10 when closet 10 is placed over the base 34. When the base 34 is secured to the floor 80, closet 10 is placed over base 34. Closet 10 may then be properly secured to floor 80. Closet 10 is also properly secured to the frame work of the building 84 by any suitable means such as, for example, nailing.

The base 34 consists of a rectangular member 50 having four edges 62 (only two edges 62 are shown in FIG. 3), and four sidewalls 54 (only the front sidewall 54 is shown in FIG. 3). Each sidewall 54 extends downward from its respective edge 62. It can be seen where the rectangular member 50 and the sidewalls 54 together define a volume. A lip 58 is connected to the bottom edge of said sidewalls 54 and extends in a direction outward of the sides 54 and generally parallel to upper surface 50. Ribs (not shown), preferably consisting of strips of lumber having a thickness equal to or slightly less than the height of side walls 54, are mounted in volume of base 34 so as to provide a sufficient support to accommodate the weight demands of base 34. The base 34 is of the same general shape as the width and depth of the closet 10. Upper member 50 of base 34 is proportioned to be slightly smaller than the width the depth of the closet 10 so that when the closet 10 is placed over the base 34, the interior surface of the first sidewall 12, second sidewall 14, back wall 16, and front wall 18 abuts the exterior surface of sidewalls 54 and the bottom edge of closet 10 rests on lip 58.

As shown in FIG. 3, drywall 42 can be attached to the exterior surface of closet 10 by affixing it by nailing or screwing to framing 40. Framing 40 provides members to receive the nails or screws which pass through the drywall. furthermore, a conventional closet door 66 can be hung in opening 22 of closet 10.

Closet 10 can also be equipped with any number of devices to provide shelving within the volume of the closet. This feature adds to the versatility of the closet. As shown in FIG. 1, a plurality of generally rectangular shelf brackets 46 are provided in closet 10. The shelf brackets 46 of the present invention are located intermediate the ceiling 20 and base 34. Each bracket 46 has an upper surface 88, a lower surface 92, a first sidewall 90, a second sidewall 94, and a bottom surface 96. Brackets 46 are aligned in a side-by-side manner within the closet volume so that when a shelf (not shown) is placed on the upper surface 88 of brackets 46 so aligned, that said shelf is parallel to ceiling 20 and base 34.

Figure 4:
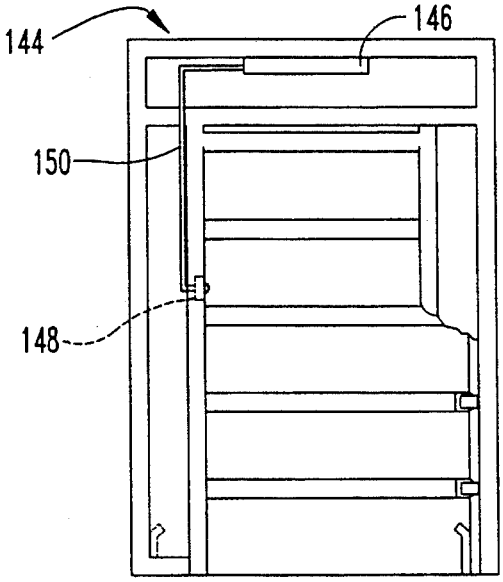
FIG. 4 illustrates a front view, partially broken away in a front section, of a second specific embodiment of the modular closet of the present invention wherein a lighting assembly is included.

FIG. 4 illustrates alternate shelf supports rather than being a series of individual members, the shelf support is continuous. The shelf is placed on the upper surface of the shelf support.

Furthermore, closet 10 can be provided with a pre-wired lighting assembly 144. The lighting assembly 144 shown in FIG. 4 consists of a lighting fixture 146, a switch 148, and a wire 150 connecting lighting fixture 146 and switch 148. Lighting fixture 146 is contained in the closet volume. Lighting assembly 144 is installed in closet 10 during the construction of closet 10 and is pre-wired so that only one electrical field connection is required when closet 10 is installed at building site. In operation, the light is illuminated when the closet door is open. The light is not illuminated when the closet door is closed.

Additionally, closet 10 can be provided with a vent system comprising a plurality of apertures contained in closet 10 to allow a flow of air through the volume of closet 10. In FIG. 1 there is provided a vent aperture 126 located in ceiling 20, a vent aperture 128 located in sidewall 12, and a corresponding vent aperture 128 located in sidewall 14. Vent aperture 126 is provided with a screen 130. Vent aperture 128 is provided with a screen 132. In the present invention, the vent system is also provided with deodorizer holder 134 and deodorizer 136. Deodorizer holder 134 is affixed to the exterior surface of sidewall 12 below vent hole 128 so that deodorizer 136 is adjacent to vent aperture 128. Air circulating through vent aperture 128 picks up the scent of deodorizer 136. Thus, the closet always presents the desired odor.

Figure 5:
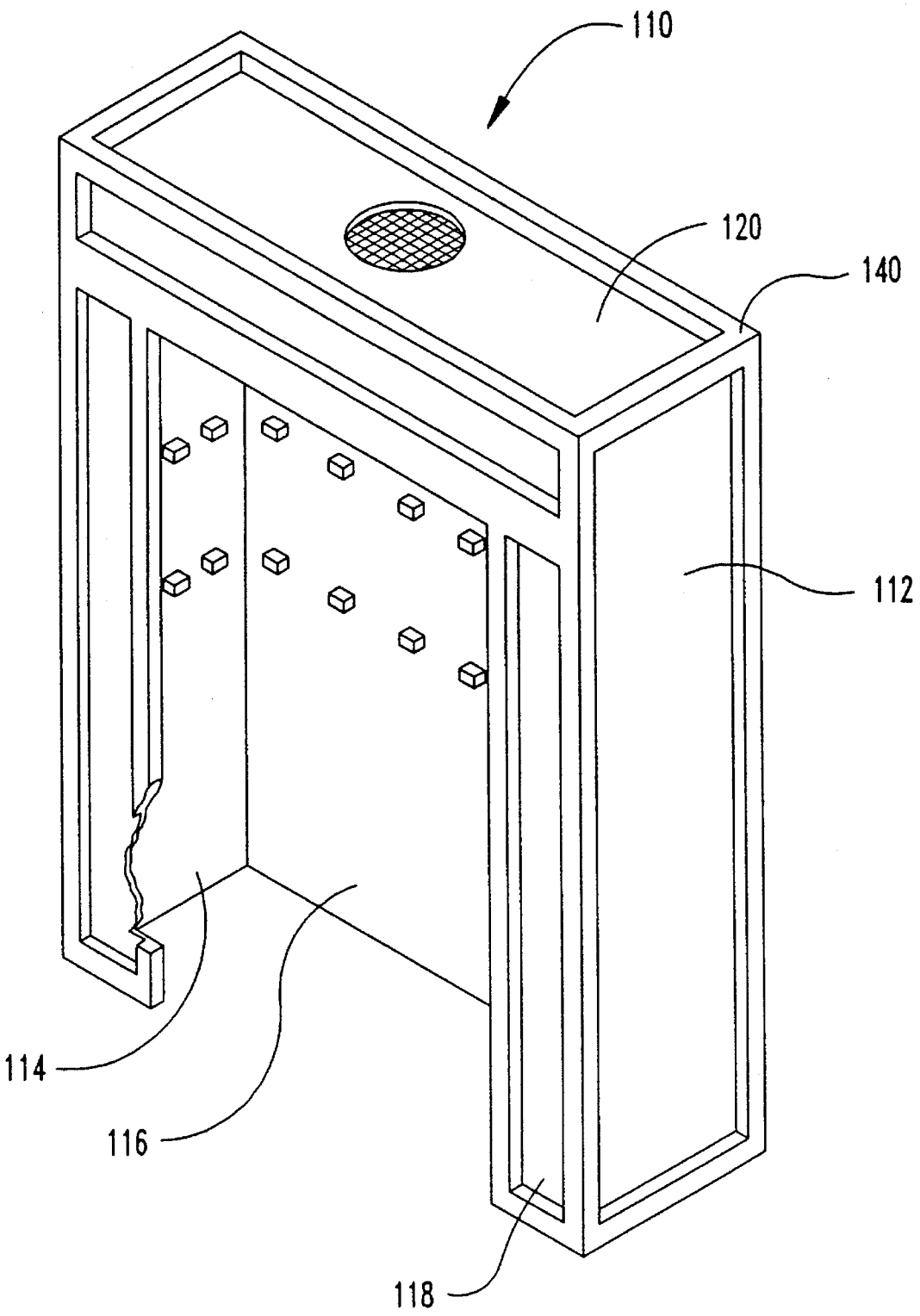
FIG. 5 illustrates a perspective view, partially broken away in a section, of a third specific embodiment of the modular closet in accordance with the invention.

FIG. 5 shows another specific embodiment of the prefabricated closet of the present invention. The prefabricated closet of FIG. 5 is generally indicated as 110. Closet 110 has a first sidewall 112, a second sidewall 114, a back wall 116, a front wall 118 and a ceiling 120. Additionally, closet 110 has integral framing sections 140. In closet 110, the first sidewall 112, second sidewall 114, back wall 116, front wall 118, ceiling 120 and framing section 140 are formed via a dual laminate vacuum form process or an injection molding process as a single integral unit. The single integral unit may be made of molded fiberglass, polypropylene, acrylic, or some other similar type of material suitable for molding and having a smooth, durable finish. The molded unit is typically reinforced by a fiber reinforced plastic reinforcing material. The reinforcement may be applied by a chop shot process.

Figure 6:
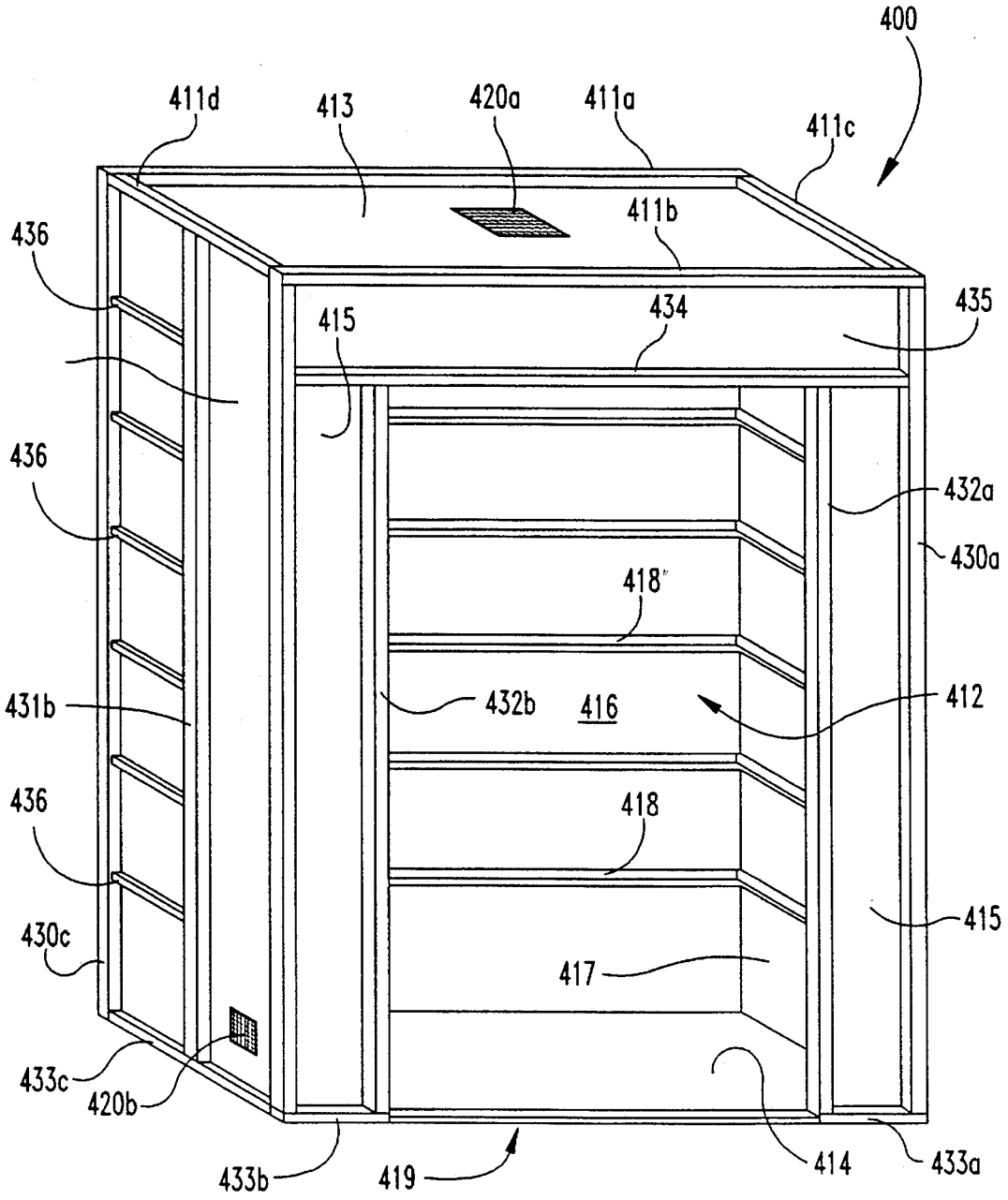
FIG. 6 illustrates in a perspective view of a fourth specific embodiment of a prefabricated, modular storage enclosure in accordance with the present invention.
Figure 7:
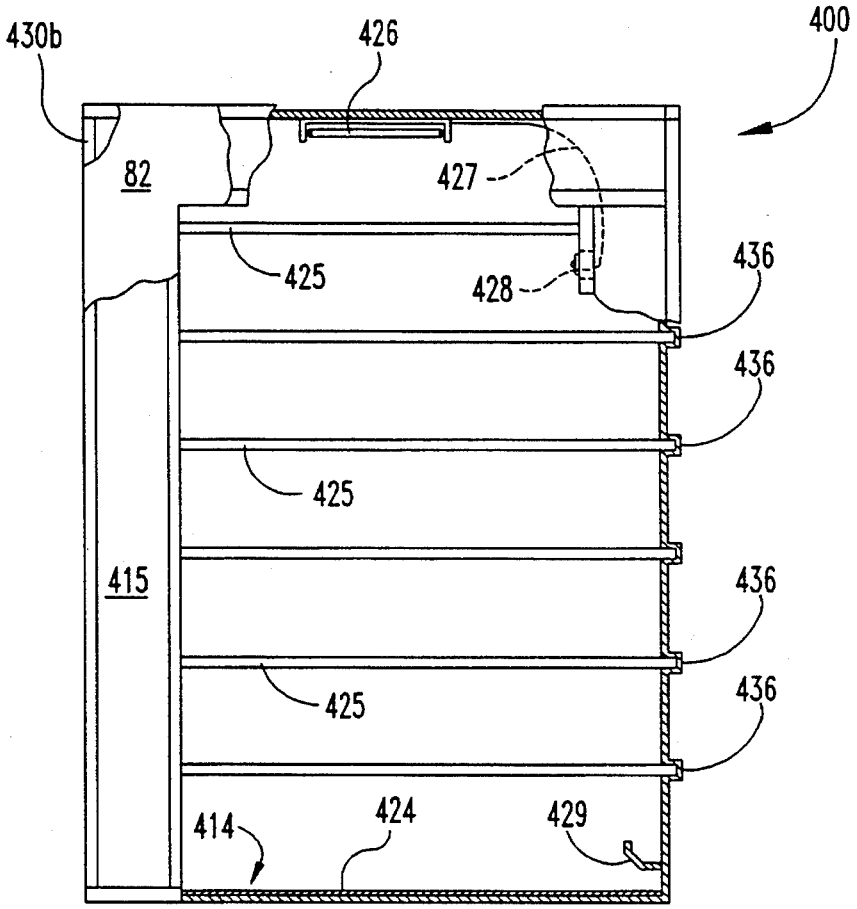
FIG. 7 illustrates a frontal view, partially broken away in a section, of the prefabricated, modular storage enclosure of FIG. 6.
Figure 8:
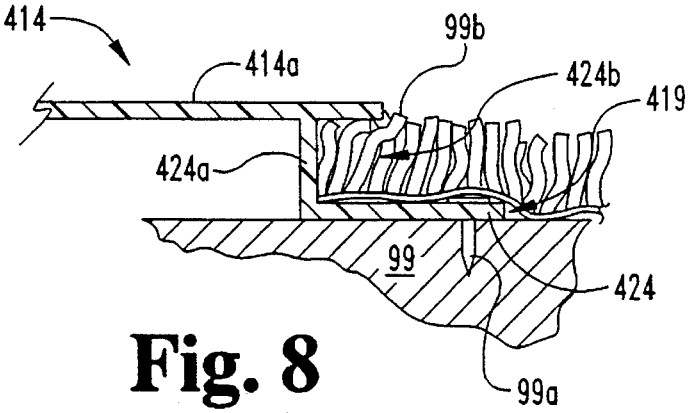
FIG. 8 illustrates a cross section view of a finished flooring attachment flange of a prefabricated, modular storage enclosure of FIG. 6.

Referring to FIGS. 6–13, two additional embodiments of the present invention which are closely related are disclosed. FIGS. 6 and 7 disclose modular closet enclosure 400 secured to and having an outer frame for structural support both of the modular closet and of surrounding wall structure. The enclosure includes a ceiling member 413 and oppositely disposed floor member 414 which are both preferably oriented horizontal and parallel to one another. A pair of side walls 417 are oppositely disposed and run vertically between the floor and the ceiling. A rear wall 416 is provided at the back of the closet and running transversely between respective rear edges of the side walls 417. Furthermore, the enclosure preferably includes a front wall having front wall portions 415 and preferably a header front wall portion 435. As before, these wall portions and ceiling and floor members preferably are fabricated from molded plastic (e.g. acrylic, or resinous material). The preferred method of prefabrication is to mold rear wall 416, side wall 417, ceiling member 413 and floor member 413 from a single, unitary molded construction. Thereafter, the front wall is secured thereto in single or multipiece panels.

The enclosure is moisture proof, or at least substantially moisture proof as well as insect and rodent repellent. Optional but preferred ventilation is provided through an upper ventilation port 420*a* and lower-ventilation ports 420*b* illustrated in the ceiling member and the side walls respectively. Note further that it is greatly preferred that any ventilation openings, such as vents 420*a* and 420*b* have a grate, mesh, fine screen or other such structure to provide entry protection, such as against rodents and other vermin, and may be small enough to provide entry protection against insects as well.

Preferably, the molded surface of the inside of the enclosure 400 has a smooth, finished appearance, available in a multitude of colors but preferably white or off-white. Although the interior walls typically are smooth, one optional mechanism for mounting shelving is the providing of molded channels 418 in rear wall 416 and optionally in side walls 417. Such channels 418 are recessed and designed to receive a storage shelf in the prefabricated closet on surface 418*a* of the recess (see FIG. 12), preferably before the installation of front walls 415 and 435. The muirshelf configuration as illustrated in FIGS. 6, 7, 10 and 11 are well suited for storage of many small articles, such as for pantries, linen closets, and/or business storage applications. It is to be understood that the present invention may be practiced using one or more clothes hanging closet rods running transversely between and mounted to side walls 417. It is further to be understood that the recess structure for supporting shelves such as channels 418 is merely one optional approach and a variety of other mounting mechanisms may be provided. Advantages to the illustrated approach using recesses are that the channels which may be integrally molded form rib structures having shelving 425 therein which act to rigidify the side walls and rear walls as well as to reinforce and stiffen enclosure 400. Another approach (not illustrated) is to provide channels 418 only in rear wall 416 and to provide wire mesh shelving mounted at its forward lateral corners to side walls 417 by mounting hardware.

The closet assembly's enclosure 400 is supported along its exterior by a relatively stiff and rigid frame. One such frame is illustrated in FIGS. 6 and 7 comprising four corner posts 430*a*, 430*b*, 430*c* and (not shown) 430*d* (see FIG. 10). These four corner posts are vertically disposed and (in combination with horizontal plates above and below) preferably run the entire vertical length from floor 414 to ceiling 413. The preferred total height of the structure is about 94 ½ inches. These corner posts are interconnected by a plurality of upper horizontal members or plates, 411*a*, 411*b*, 411*c* and 411*d*. Moreover, the vertical corner posts are interconnected by a plurality of lower horizontal members or plates 433*a*, 433*b*, 433*c* and 433*d* and (see FIG. 10) 433*e* (see FIG. 13). Preferably, each side wall is further supported by at least one additional generally vertical post 431*b* or 431*a* running between and attached to the respective lower and upper horizontal members, such as lower horizontal member 433*c* and upper horizontal member 411*d*. Such vertical posts 431*b* provide at least two functions. The first is to substantially increase the stiffness and rigidity of the overall prefabricated closet to better provide a load bearing structure against which walls may be erected. The other is to provide a load bearing column for the forward corner edges of the shelving material and/or the closet rod to be installed in the closet. Note that although the Figures illustrate this intermediate side panel post 431*b* as approximately halfway between the respective front corner post 430*b* and rear corner post 433*c*, it may be adjusted according to design such as moving it forward and nearly, if not completely, next to the forward post 430*b*.

The inner edge of doorway 412 is preferably defined by two laterally inward vertical posts or jambs 432*a* and 432*b* as well as a horizontal header bar 434. These jambs and header 434 along with horizontal member 411*b* and the front corner posts provide coplanar structural support for front wall 415 and 435. Moreover, they provide a mounting frame with which to attach a door, such as door 83 (see FIG. 13) or other forms of doors such as bi-fold doors. Moreover, the inward wrapping structure including the vertical jambs or post 432*a* and 432*b* spaced inwardly apart from the corner posts provide additional stiffness to the overall box structure of enclosure 400 and the overall closet assembly. As indicated, these provide sufficient structural strength to act as a load bearing wall and/or anchor against which the load bearing wall is abutted and framed to. Note further that the framing structure including posts 432*b* and 430*b* provide the most outward projecting surfaces of, the overall prefabricated closet assembly. In this way, these flat, parallel working surfaces provide the surfaces to which wall board is directly attached, such as wall board 82 illustrated in FIGS. 7 and 13.

Floor member 414 has a front edge 419 running between jambs 432*a* and 432*b* and typically defining the lower edge of opening 412. In the preferred embodiment, as illustrated in greater detail in FIG. 8, leading edge 419 is defined by a lower flange member 424 connected to the remainder of floor 414 by, for example, vertical flange 424*a*. Preferably, flange 424 is nailed, screwed or otherwise adhered or attached directly to the subflooring of the structure, such as flooring 99 (see FIG. 8 and FIG. 13) such as by fastener 99*a* (see FIG. 8). Moreover, flange 424, and flange 424*a* along with flange 424*c* define a channel recess or capture cavity 424*b*. Recess 424*b* provides a lateral space along the bottom of closet opening 412 in which a trim piece, such as wood, wall-to-wall carpeting, or finished flooring, illustrated in FIG. 8 as 99*b* (shown as carpeting) may be tucked to provide a clean finished edge. Note that since flange 424 lies in a lower plane than the top surface 414*a* floor member 414, generally top surface 414*a* is flush or nearly flush with the finished floor treatment 99*b*.

FIG. 7 illustrates electrical lighting fixture 426 with wiring 427 connected to switch 428. Switch 428 may be manual, although preferably is activated in response to opening of the door to turn on the light when the door is opened and to turn off the light when the door is closed. Light fixture 426 is prefabricated in the closet unit leaving only two wires (and optionally a ground wire) for quick and easy coupling on the job site without the need to install the lighting fixture itself on site.

Figure 9:
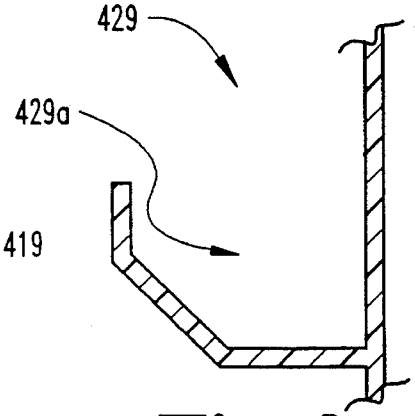
FIG. 9 illustrates a cross section view of an air freshener holder of the prefabricated, modular storage enclosure of FIG. 6.

FIG. 7 and FIG. 9 illustrate a cross sectional view of an integral air freshener holder 429. Preferably, such holder is integral with and protrudes from one of the walls of the enclosure, such as side wall 417. The interior surface of holder 429 preferably is an interior surface of the interior volume of the prefabricated, modular storage enclosure also having a smooth exterior surface. The volume 429*a* defined by holder 429 facilitates the simple insertion, removal, and reinstallation of an air freshener. Optionally, holder 429 may be provided at the mouth of a lower air vent, such as vent 420*b* to provide air freshening of incoming air.

Figure 10:
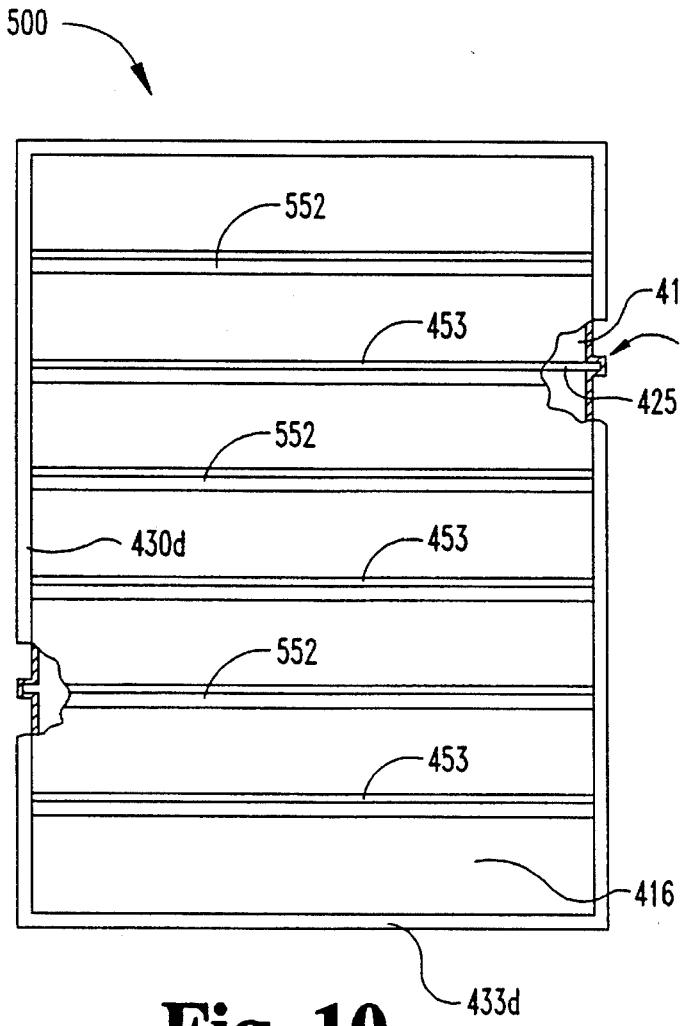
FIG. 10 illustrates a rear wall view of a fifth specific embodiment of a prefabricated, modular storage enclosure of in accordance with the present invention.
Figure 11:
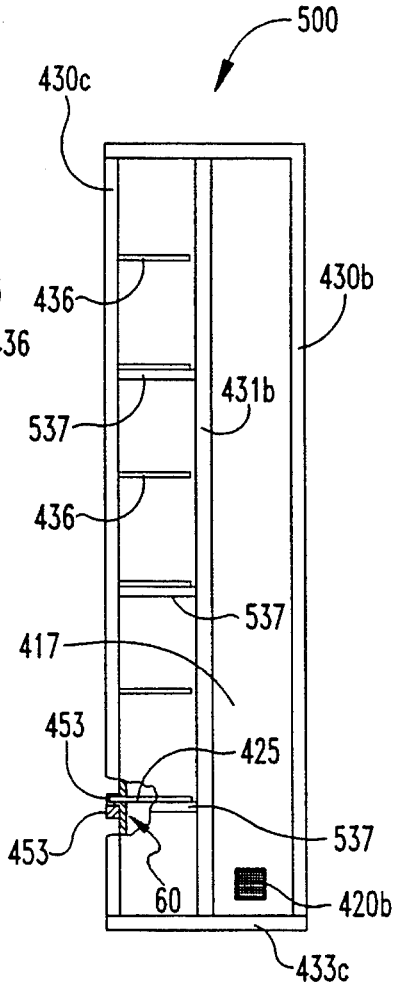
FIG. 11 illustrates a side wall view of the prefabricated, modular storage enclosure of FIG. 10.
Figure 12:
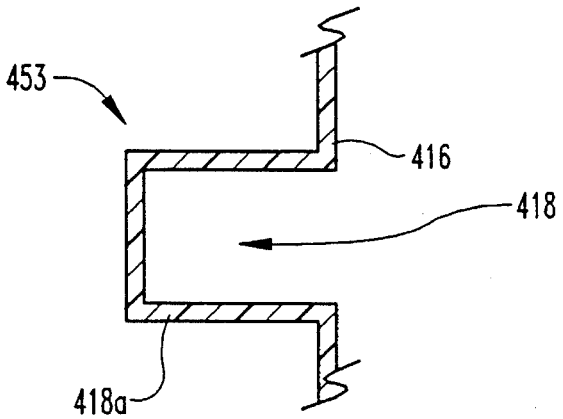
FIG. 12 illustrates a cross section view of a continuous and horizontally aligned organizational shelf support channel of the prefabricated, modular storage enclosure of FIG. 6.
Figure 13:
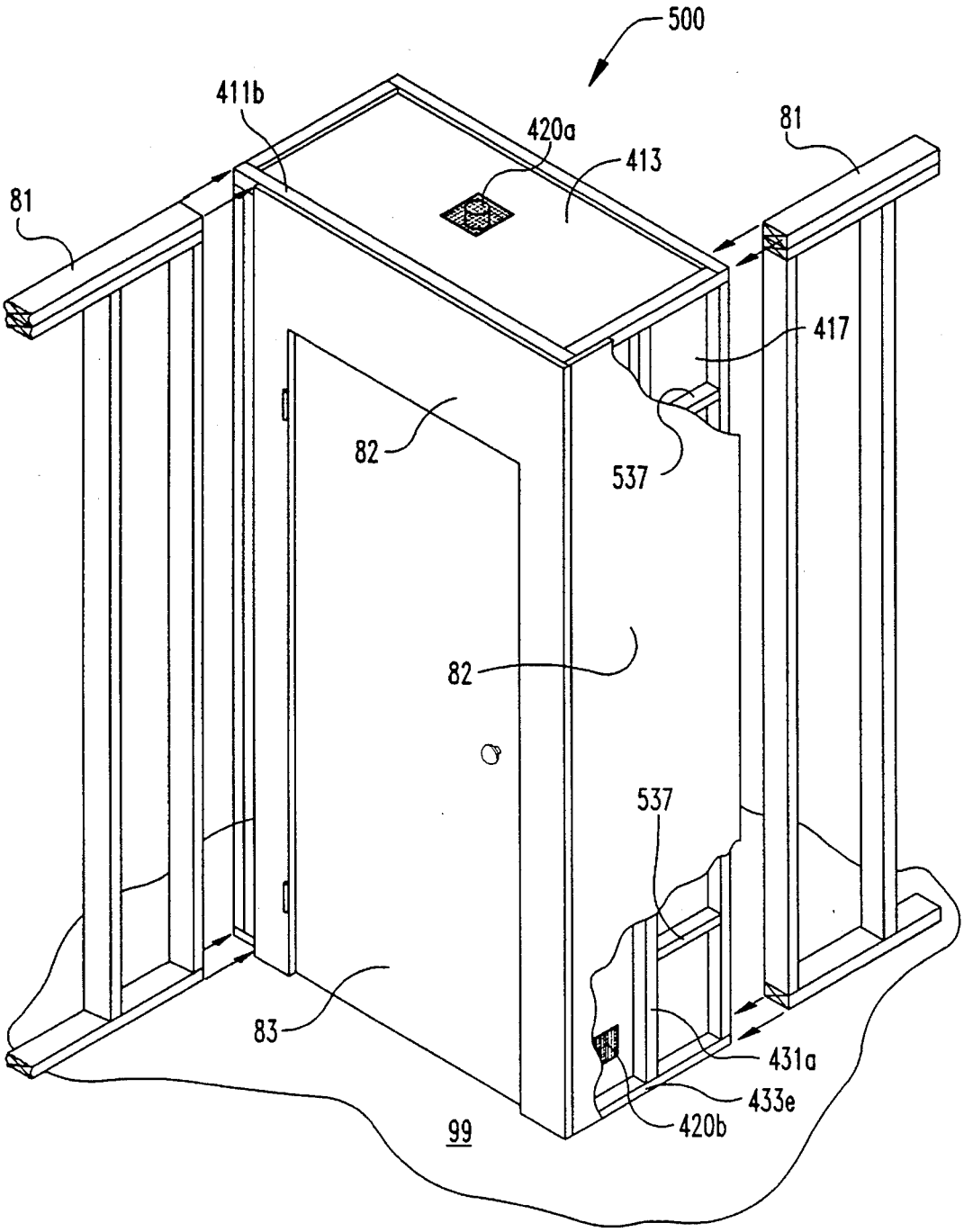
FIG. 13 illustrates a perspective view of the prefabricated, modular storage enclosure of FIG. 10, installed in a structure, in accordance with the present invention.

FIGS. 10, 11 and 13 illustrate a fifth embodiment of enclosure, comprising enclosure 500. Enclosure 500 is essentially identical to enclosure 400 previously described with a few modifications. Specifically, such modifications comprise additional reinforcing members in the frame, such as horizontal struts 537 (see FIGS. 11 and 13) on the side panels and members 552 along the exterior of rear wall 416. Such struts 537 on the side panels interconnect corner posts, such as corner post 430 with either the other corner post or the intermediate vertical post 431*b*. Such arrangement provide a truss structure 538 along the side panel with the struts interconnected between the respective vertical posts. It is to be understood that diagonal, X-bracing or other truss configurations may likewise be utilized. The truss configuration greatly stiffens and provides structural support to allow secure attachment of wall framing members, such as framing members 81 (see FIG. 13) to the closet assembly. Likewise, the rear lateral struts 552 stiffen rear wall 416, stiffen and strengthen the entire closet structure, and as arranged provide additional support for the back edges of shelving members 425. In the preferred embodiments, each of the posts and horizontal members and struts are made of 2"×2" wood, although other sized and materials (e.g. metal, plastic) may be used. The overall interior depth of the closet (front to rear) is usually greater than 12 inches; the overall interior width (side to side) is usually greater than 36 inches; and, the overall exterior height is usually 94 ½ inches top to bottom. The width is typically greater than the depth, and the height is greater than the width.

Figure 14:
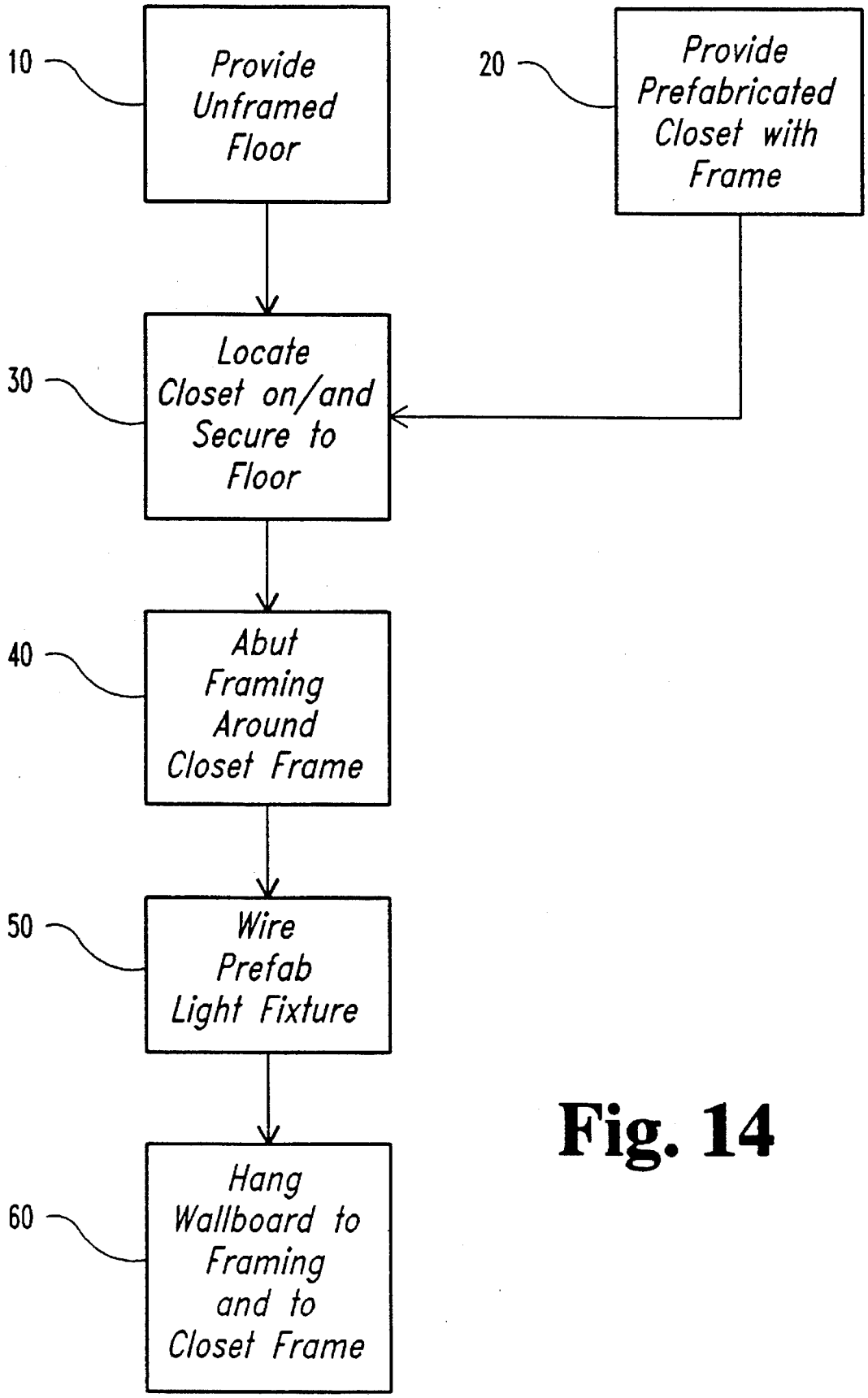
FIG. 14 illustrates a method of installing a prefabricated closet unit.

The drawing Figures, and in particular FIGS. 13 and 14, illustrate a method in accordance with the present invention. Referring to FIG. 14 specifically, the first step 10 is providing an unframed floor (such as floor 99). The second step 20 is to provide a prefabricated closet according to the present invention, such as enclosure 500 along with its prefabricated supporting frame. The third step 30 is to locate the closet on a predetermined location on a portion of floor 99 according to the construction plans. As indicated, the floor at this point is unframed, either entirely unframed or at least unframed in the portion of the floor in the general vicinity in which the closet is being installed. Securing of the closet assembly to a floor may be done in a variety of ways, including securement by fastener 99*a* (see FIG. 8) as previously discussed.

The fourth step 40 includes abutting framing 81 to closet assembly 500 which has been previously mounted to floor 99. Specifically, note that the framing is laid or abutted so that it lies coplanar with one of the exterior faces of the frame of the closet structure. In this way, wall board, such as dry wall, 82 may be laid across the framing structure of the closet assembly and contiguously and coplanarly lay across framing 81. This approach is distinct from having a modular closet which is a retrofit add on to a preexisting wall, such as by securing it behind or in front of the preexisting wall. As illustrated, the closet assembly becomes an integral part of and foundation element for the overall wall assembly while enjoying the quality control and fabrication benefits of a prefabricated closet. As indicated, the height of the closet assembly is designed at 94 ½ inches to facilitate this method. At such heights, the bottom of the two header boards of frame 81 abuts the closet frame, whereas the top header board spans over and in contact with the top surfaces of the upper horizontal members (411*a*, 411*b*, 411*c*, 411*d*) allow rigid and integral securement such as with nails or other fasteners. The fifth step, which is optional, includes wiring the prefabricated light fixture, such as light fixture 426, to wiring (not shown) connected to the remainder of the electrical system. Since the lighting fixture 426 has been pre-installed, this is an extremely quick and easy step not requiring undue time of an electrician. The sixth step 60 is to hang wall board 82 to the framing 81 and to the closet frame, such as two struts 537 and/or posts 431*a*, posts 430*a*, post 432*a* and the like. As illustrated, wall board 82 covers the front surface of the closet making it an integral portion of a quality wall product. For example, front wall 415 and wall board 82 form a sandwich between which vertical post 432*a* and vertical post 430*a* are disposed. Similarly, the other prefabricated interior wall members of the closet and the oppositely disposed wall board sandwich the structural frame therebetween. Thereafter, conventional taping, spackling, sanding, painting and/or wallpapering may be accomplished for a finished wall. Finally, finished flooring, such as flooring 99*b* is installed along the front edge of closet floor 414 providing a finished trim appearance while saving time and labor and material costs since the interior of the closet does not require expensive installed finished flooring. Preferably, a door such as door 83 is also hung either directly to the closet and/or in connection with an installed door frame and/or door trim such as those conventionally used by carpenters in installing doors.

What is claimed is:

1. A prefabricated closet assembly for installation on a structure floor, comprising:

a) an enclosure defining a closet volume having a finished interior surface and being accessible by a front opening, comprising:

(1) a pair of oppositely disposed vertical side walls connected to each other by a transverse vertically disposed rear wall, each said side walls having a front end and a rear end;

(2) a horizontal ceiling member connected to said side walls and said rear wall;

(3) a horizontal floor member connected to said side walls and said rear wall, wherein said floor member is adapted to overlie and cover the floor of the structure;

said floor member having a front edge and means for securing said floor member to the structure floor along said front edge of said floor member, and wherein said front edge comprises a forwardly projecting flange member located in a plane lower than said floor member and arranged to lie flush along a top surface of the structure floor;

(4) a closable door attached to said enclosure and an upper vent and a lower vent to provide ventilation of said closet volume when said door is closed; and (5) wherein said side walls, said rear wall, said ceiling member and said floor member are all molded together to form a unitary member;

b) a transverse storage member connected to and running transversely between said pair of side walls;

c) a support frame exteriorly connected to and supporting said enclosure, wherein said enclosure and said support frame are modular separate from the structure, said support frame comprising:

(1) four vertical corner posts, said vertical corner posts include a pair of front vertical corner posts positioned along said front end of each of said side walls, and a pair of rear vertical corner posts positioned along said rear end of each of said side walls;

(2) a plurality of horizontal members interconnecting upper ends of at least two said vertical corner posts;

(3) a plurality of horizontal members interconnecting lower ends of at least two said vertical corner posts;

(4) a pair of load bearing structural truss frames respectively positioned along an outside of each of said side walls, said truss frames disposed between a front corner post and a corresponding rear corner post and including at least one said vertical corner post, said truss frames comprising at least a pair of generally vertical posts and a plurality of struts therebetween;

(5) at least one front vertical post disposed between the front corner post of each said sidewalls, a vertically elongated front wall member interior of and supported by said front vertical post, said front wall member running from said floor member to said ceiling member, wherein said front wall member comprises a portion of said enclosure and adjoins one of said side walls; and, d) a lighting fixture pre-installed in said closet assembly.

2. The prefabricated closet assembly of claim 1 and further comprising:

(c)(6) at least one side vertical post positioned outside a side wall between a front corner post and a corresponding rear corner post, wherein said side vertical post is secured to a plurality of said struts and forms a portion of said truss frame.

3. The prefabricated closet assembly of claim 2 and further comprising a horizontal trim piece covering said front edge of said floor member.

4. A prefabricated closet assembly for installation on a floor of a structure, comprising:

a) an enclosure defining a closet volume having a finished interior surface and being accessible by a front opening, comprising:

(1) a pair of oppositely disposed vertical side walls connected to each other by a transverse vertically disposed rear wall, each said side walls having a front end and a rear end;

(2) a horizontal ceiling member connected to said side walls and said rear wall; and (3) a horizontal floor member connected to said side walls and said rear wall, said floor member having a front edge and means for securing said floor member to the floor of the structure along said front edge of said floor member, wherein said: front edge comprises a forwardly projecting flange member located in a plane lower than said floor member and arranged to lie flush along a top surface of the floor of the structure;

b) a transverse storage member connected to and running transversely between said pair of side walls; and, c) a support frame exteriorly connected to and supporting said enclosure, wherein said enclosure and said support frame are modular separate from the structure, said support frame comprising:

(1) four vertical corner posts, said vertical corner posts define a pair of front vertical corner posts positioned along said front end of each of said side walls, and a pair of rear vertical corner posts positioned along said rear end of each of said side walls;

(2) a plurality of horizontal members interconnecting upper ends of at least two said vertical corner posts;

(3) a plurality of horizontal members interconnecting lower ends of at least two said vertical corner posts; and (4) a pair of load bearing structural truss frames respectively positioned along an outside of each of said side walls, said truss frames disposed between a front corner post and a corresponding rear corner post and including at least one said vertical corner post, said truss frames comprising at least a pair of generally vertical posts and a plurality of struts therebetween, wherein said truss frames enhance rigidity of said support frame and wherein said closet assembly including said support frame is prefabricated.

5. The prefabricated closet assembly of claim 4 and further comprising a horizontal trim piece covering said front edge of said floor member.

6. A prefabricated closet assembly for installation on a floor of a structure, comprising:

a) an enclosure defining a closet volume having a finished interior surface and being accessible by a front opening, comprising:

(1) a pair of oppositely disposed vertical side walls connected to each other by a transverse vertically disposed rear wall;

(2) a horizontal ceiling member connected to said side walls and said rear wall; and, (3) a horizontal floor member, wherein said floor member overlies and covers the floor of the structure;

b) a transverse storage member connected to and running transversely between said pair of side walls;

c) a support frame exteriorly connected to and supporting said enclosure, wherein said enclosure and said support frame are modular separate from the structure; and, d) wherein said floor member has a front edge for securing said floor member to the structure floor along said front edge of said floor member, wherein said front edge for securing said floor member to the structure floor comprises a forwardly projecting flange member located in a plane lower than said floor member and arranged to lie flush along a top surface of the structure floor.

7. The prefabricated closet assembly of claim 6 and further comprising a horizontal trim piece covering said front edge of said floor member.

* * * * *

UNITED STATES PATENT AND TRADEMARK OFFICE

CERTIFICATE OF CORRECTION

PATENT NO. : 5,467,562
DATED : November 21, 1995
INVENTOR(S) : Phillip R. Holland It is certified that error appears in the above-indentified patent and that said Letters Patent is hereby corrected as shown below:

In Column 5, line 49 "muirshelf" should read --multishelf--.

Signed and Sealed this

Eleventh Day of June, 1996

*Attest:*

*Attesting Officer*

BRUCE LEHMAN

*Commissioner of Patents and Trademarks*